US006520106B1

(12) United States Patent
Listle

(10) Patent No.: US 6,520,106 B1
(45) Date of Patent: Feb. 18, 2003

(54) PERIPHERALLY WEIGHTED FLOATING PLATFORM SYSTEM

(76) Inventor: Jay Listle, 34 Central Ct., Tarpon Springs, FL (US) 34689

( * ) Notice: Subject to any disclaimer, the term of this patent is extended or adjusted under 35 U.S.C. 154(b) by 0 days.

(21) Appl. No.: 09/932,630

(22) Filed: Aug. 17, 2001

(51) Int. Cl.[7] ..... B63B 35/44
(52) U.S. Cl. ..... 114/263; 114/264
(58) Field of Search ..... 114/263, 264, 114/265, 266

(56) References Cited

U.S. PATENT DOCUMENTS 5,048,448 A * 9/1991 Yoder ..... 114/263
5,050,524 A * 9/1991 Kyhl et al. ..... 114/263
5,775,248 A * 7/1998 Simola ..... 114/263

* cited by examiner

*Primary Examiner*—Stephen Avila

(57) ABSTRACT

A peripherally weighted floating platform system comprising a peripheral frame with side portions and end portions and formed of a hollow plastic structure with a heavy material therewithin. There is a plurality of stringers which are parallel with each other and parallel with the side portions of the peripheral frame and secured to the end portions of the frame. A plurality of plank members are located parallel with each other and parallel with the end portions of the frame and secured to the stringers.

6 Claims, 4 Drawing Sheets

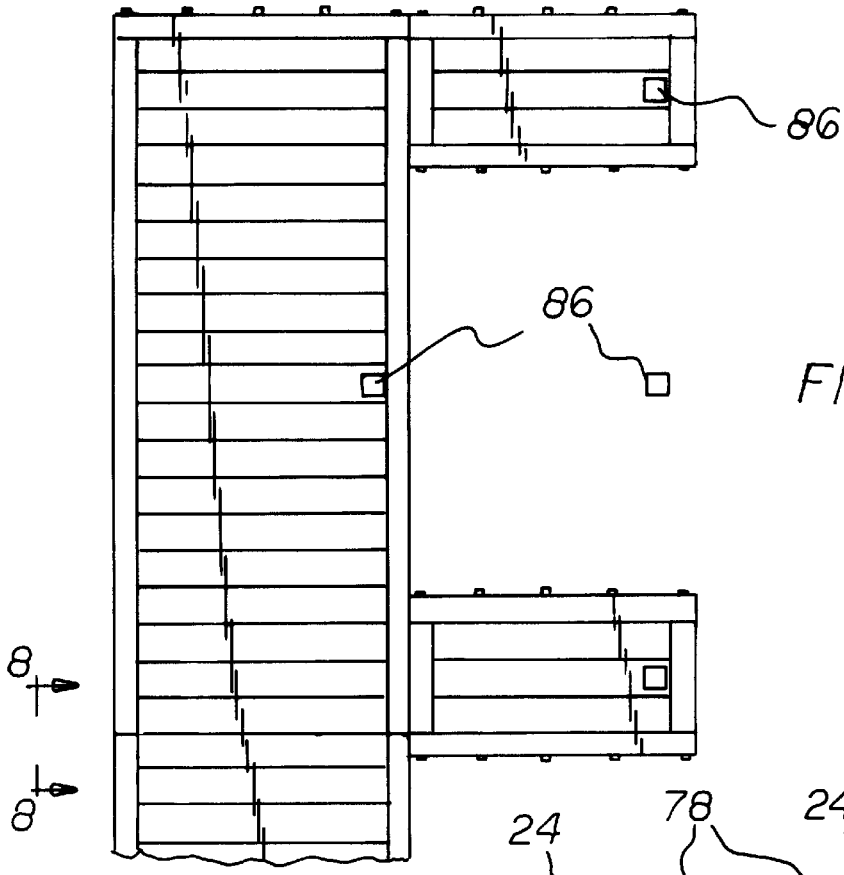
FIG 7
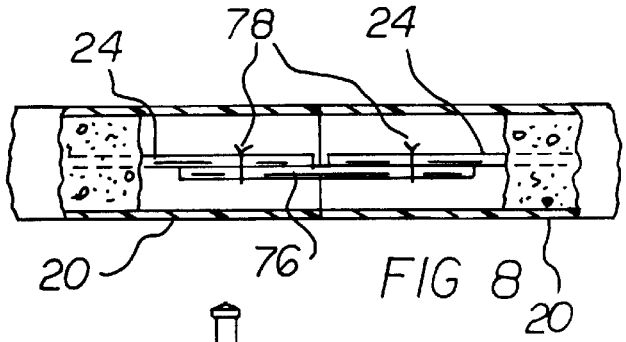
FIG 8
FIG 9
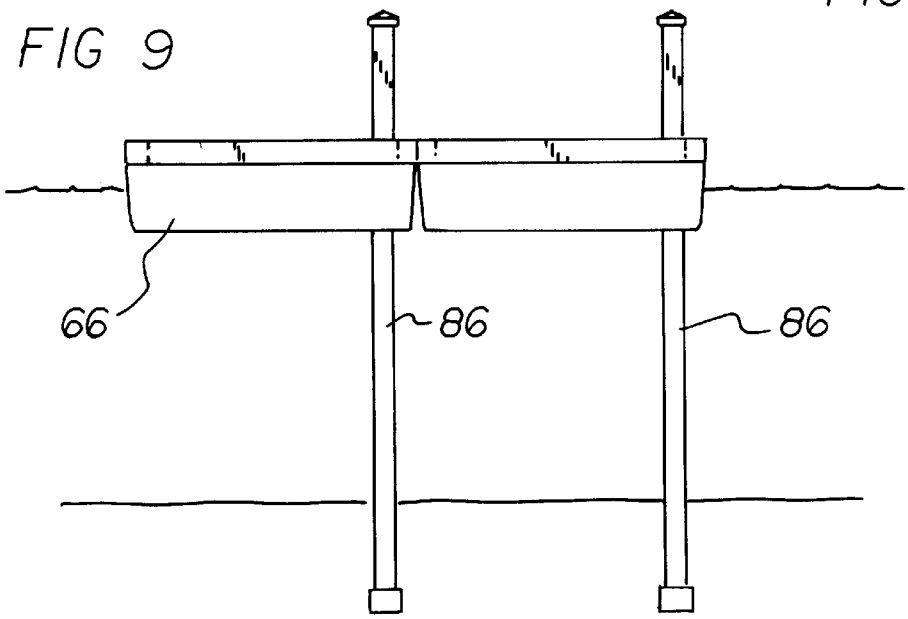

PERIPHERALLY WEIGHTED FLOATING PLATFORM SYSTEM

BACKGROUND OF THE INVENTION

1. Field of the Invention

The present invention relates to a peripherally weighted floating platform system and more particularly pertains to increasing the stability of buoyant structures.

2. Description of the Prior Art

The use of docks and piers is known in the prior art. More specifically, docks and piers previously devised and utilized for the purpose of providing a floating platform are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,580,202 to Thompson discloses a floating wharf structure. U.S. Pat. No. 4,252,470 to Sluys discloses a utility distribution system for floating piers. U.S. Pat. No. 5,199,371 to Meriwether discloses a deck structure for floating docks. Lastly, U.S. Pat. No. 5,850,720 to Willis discloses a plastic decking and securement system and method of installation.

While these devices fulfill their respective, particular objectives and requirements, the aforementioned patents do not describe a peripherally weighted floating platform system that allows increasing the stability of buoyant structures.

In this respect, the peripherally weighted floating platform system according to the present invention substantially departs from the conventional concepts and designs of the prior art, and in doing so provides an apparatus primarily developed for the purpose of increasing the stability of buoyant structures.

Therefore, it can be appreciated that there exists a continuing need for a new and improved peripherally weighted floating platform system which can be used for increasing the stability of a buoyant structures. In this regard, the present invention substantially fulfills this need.

SUMMARY OF THE INVENTION

In view of the foregoing disadvantages inherent in the known types of docks and piers now present in the prior art, the present invention provides an improved peripherally weighted floating platform system. As such, the general purpose of the present invention, which will be described subsequently in greater detail, is to provide a new and improved peripherally weighted floating platform system and method which has all the advantages of the prior art and none of the disadvantages.

To attain this, the present invention essentially comprises a peripherally weighted floating platform system for increasing the stability of buoyant structures. The platform consists of a rectangular peripheral frame. The rectangular frame has a first end portion and second end portion with a pair side portions. The side portions run parallel with each other and intersect at 90 degree angles with the first end portion and the second end portion. The side portions have a greater length than the length of the end portions. These portions are formed of a hollow plastic structure which has a cross section with dimensions of about 6.5 inches by 6.5 inches. These hollow structures have concrete therewithin and a central reinforcement bar running the length of the portions. The end portions are coupled to the side portion with a plurality of male threaded bolts and a plurality of female threaded sleeves in the side portions. The plurality of hollow plastic stringers are filled with wood having about a 4 inch by 4 inch cross section. These stringers are positioned parallel with the side portions of the peripheral frame. The stringers have a top face, a bottom face and a pair of side faces there between. The pair of outer most stringers are coupled to the adjacent side portion of the frame by screws. The top face has a plurality of apertures along its length. There is a plurality of plank members of a generally rectangular configuration positioned parallel with each other and the first end portion and second end portion of the peripheral frame. Each of the plank members has an upper face, a lower face coupled to the top face of the stringers and a pair side faces. The side faces have a liner aperture running the length thereof adjacent to the lower faces. The aperture also has a lip for coupling purposes. The plurality of coupling members are adapted to slide into the apertures of adjacent plank members to hold them at a uniform distance from each other. Each coupling member also has at least one aperture and a screw which allows the plank members to be rigidly coupled to the stringers. There is a plurality of air filled floating members secured beneath the plank members. These air filled floating members have apertures allowing them to be coupled by bolts to the side portions of the peripheral frame at equally spaced increments. The majority of the weight of the system is located in the peripheral frame.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved peripherally weighted floating platform system which has all of the advantages of the prior art docks and piers and none of the disadvantages.

It is another object of the present invention to provide a new and improved peripherally weighted floating platform system which may be easily and efficiently manufactured and marketed.

It is further object of the present invention to provide a new and improved peripherally weighted floating platform system which is of durable and reliable constructions.

An even further object of the present invention is to provide a new and improved peripherally weighted floating platform system which is susceptible of a low cost of manufacture with regard to both materials and labor, and which accordingly is then susceptible of low prices of sale to the consuming public, thereby making such peripherally weighted floating platform system economically available to the buying public.

Even still another object of the present invention is to provide a peripherally weighted floating platform system for increasing the stability of buoyant structures.

Lastly, it is an object of the present invention to provide a new and improved a peripherally weighted floating platform system comprising a peripheral frame with side portions and end portions and formed of a hollow plastic structure with a heavy material therewithin. There is a plurality of stringers which are parallel with each other and parallel with the side portions of the peripheral frame and secured to the end portions of the frame. A plurality of plank members are located parallel with each other and parallel with the end portions of the frame and secured to the stringers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is a top plan view similar to FIG. 3 but illustrating an alternate embodiment of the insertion.

FIG. 8 is a cross-sectional view taken along line 8—8 of FIG. 7.

FIG. 9 is a end elevation of the alternate embodiment of FIGS. 7 and 8.

The same reference numerals refer to the same parts throughout the various Figures.

DESCRIPTION OF THE PREFERRED EMBODIMENT

Figure 1:
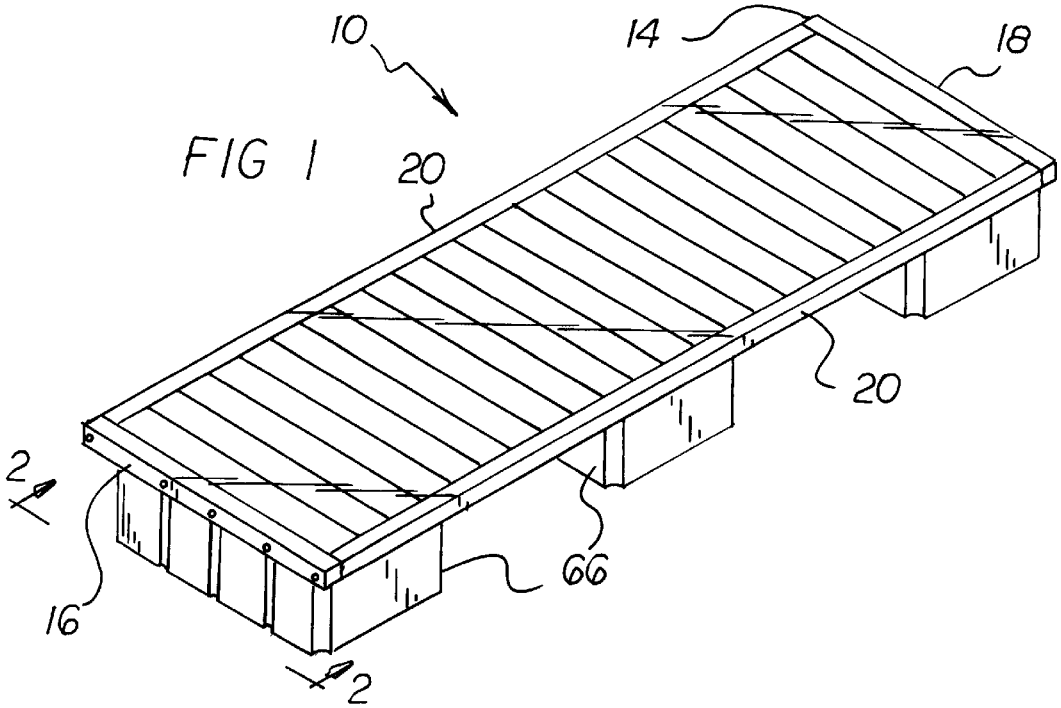
FIG. 1 is perspective illustration of a peripherally weighted floating platform system constructed in accordance with a principle of the present invention.
Figure 2:
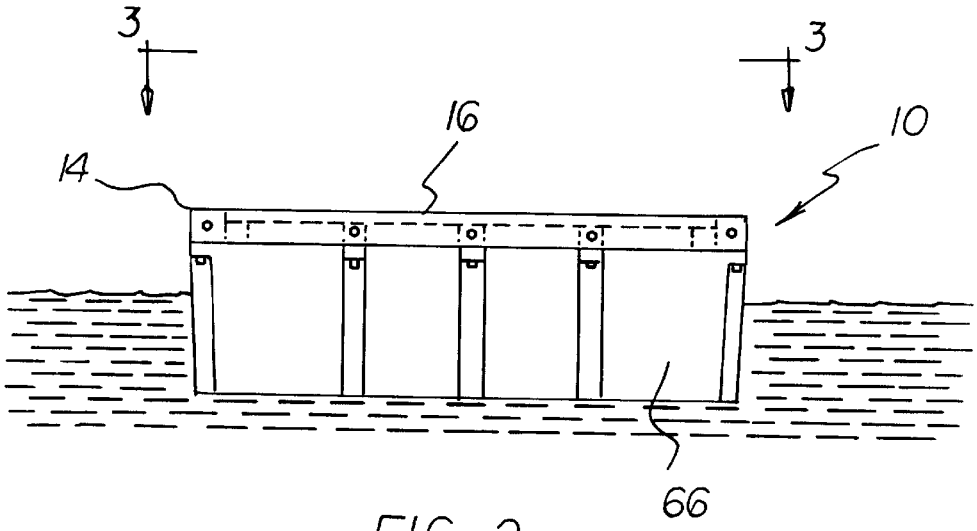
FIG. 2 is an end elevational view taken along line 2—2 of FIG. 1.

With reference now to the drawings, and in particular to FIG. 1 thereof, the preferred embodiment of the new and improved peripherally weighted floating platform system embodying the principles and concepts of the present invention and generally designated by the reference numeral 10 will be described.

The present invention, the peripherally weighted floating platform system 10 is comprised of a plurality of components. Such components in their broadest context include a peripheral frame, stringers, plank members, coupling members and air filled floating members. Such components are individually configured and correlated with respect to each other so as to attain the desired objectives.

Figure 3:
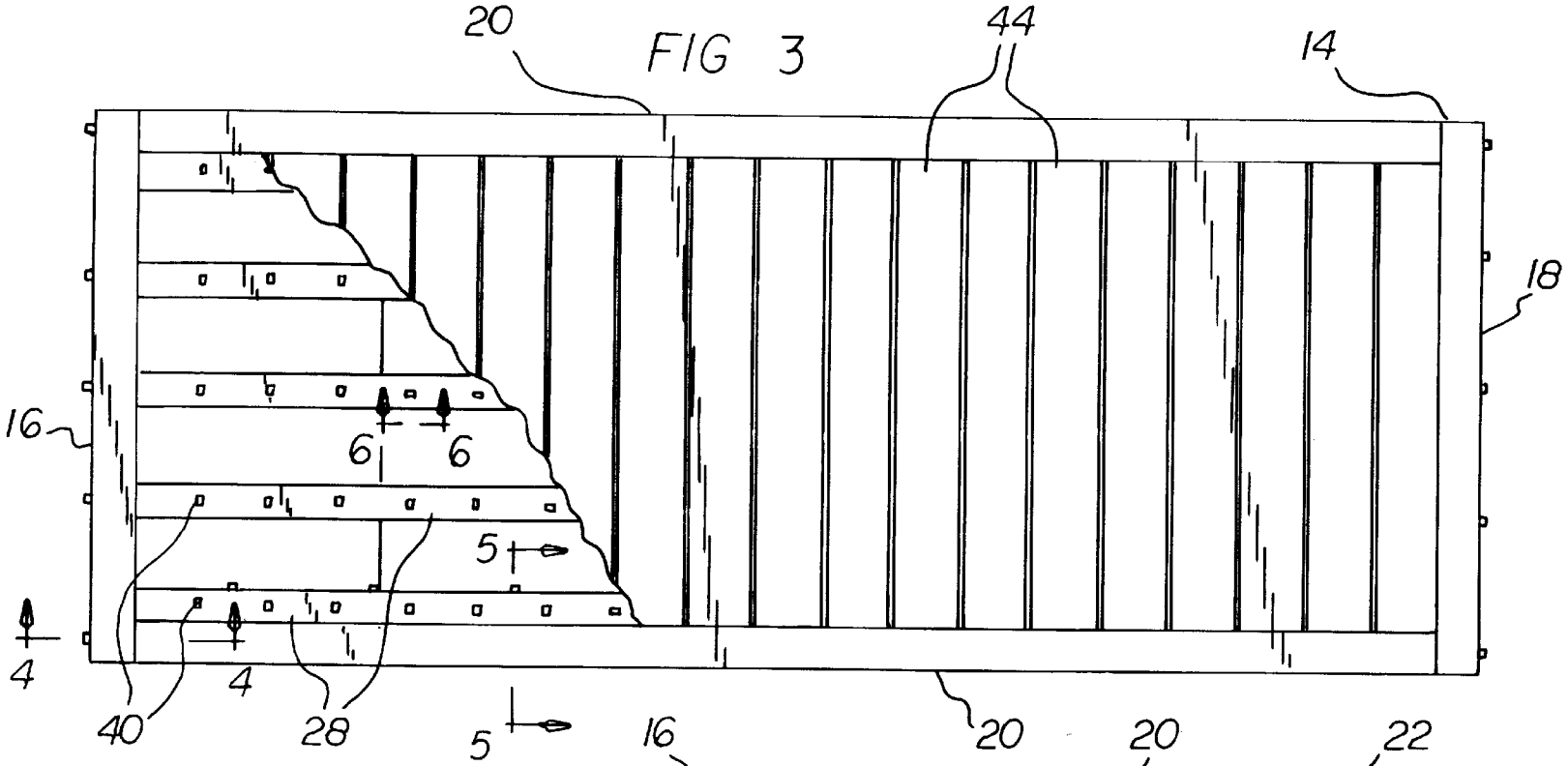
FIG. 3 is a top plan view of the system taken along line 3—3 of FIG. 2 but with parts broken away to show internal constructions thereof.
Figure 4:
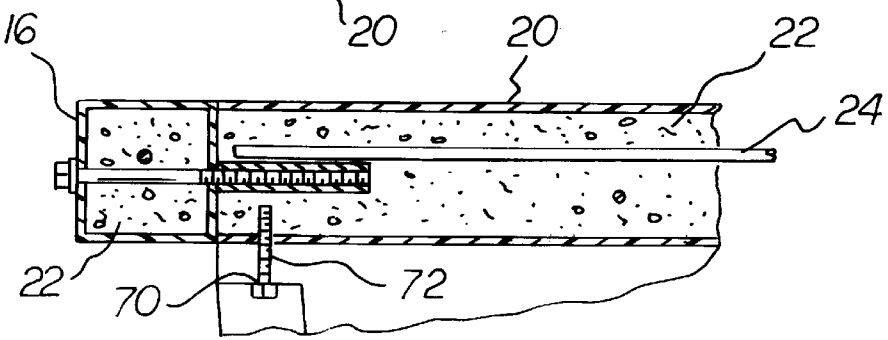
FIG. 4 is a cross-sectional view taken along line 4—4 of FIG. 3.
Figure 5:
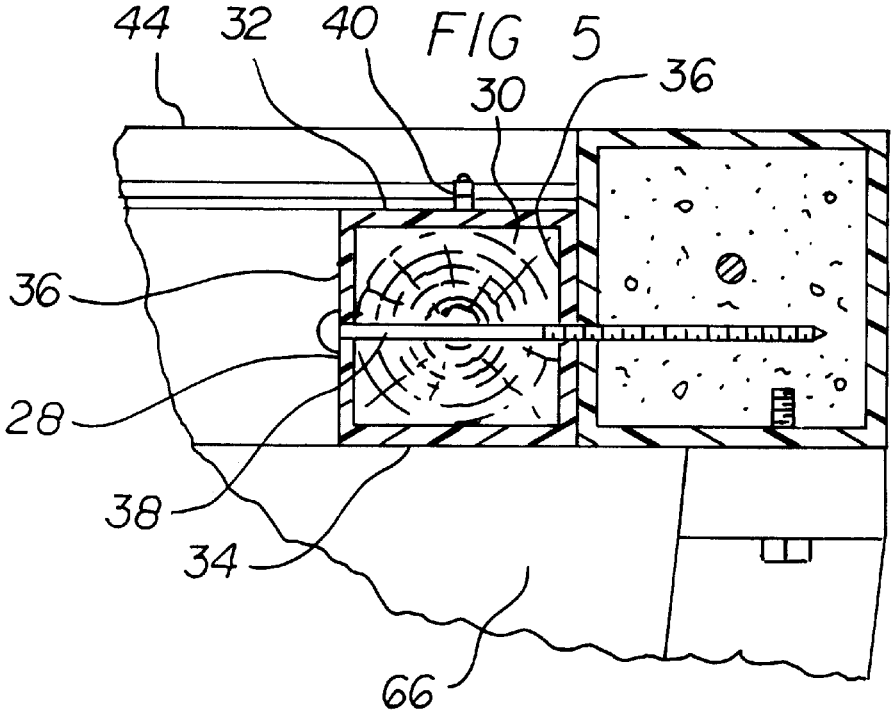
FIG. 5 is a cross-sectional view taken along line 5—5 of FIG. 3.

The present invention is a peripherally weighted floating platform system 10 for increasing the stability of buoyant structures. The platform system consists of a rectangular peripheral frame 14. The rectangular frame has a first end portion 16 and second end portion 18 with a pair side portions 20 therebetween. The side portions run parallel with each other and intersect at 90 degree angles with the first end portion and the second end portion. The side portions have a greater length than a length of the end portions. Note FIGS. 1 and 3. These portions are formed of a hollow plastic structure, preferably a rigid polyvinyl chloride (PVC), which has a cross section with dimensions of about 6.5 inches by 6.5 inches. These hollow structures have a heavy material, preferably concrete 22, therewithin and a central reinforcement bar 24 running the length of each of the portions. The end portions are coupled to the side portion with a plurality of male threaded bolts 26 and a plurality of female threaded sleeves in the side portions, preferably fabricated of a rigid plastic material such as PVC.

Next provided are a plurality of hollow plastic stringers 28. Each stringer is filled with a material, lighter than concrete, preferably wood 30. Each stringer has about a 4 inch by 4 inch cross section. These stringers are positioned parallel with the side portions of the peripheral frame. The stringers have a top face 32, a bottom face 34 and a pair of side faces 36. The pair of outer most stringers are adapted to be coupled to the adjacent side portion of the frame as by screws 38. The top face of each stringer has a plurality of apertures 40 along its length.

There is next provided a plurality of plank members 44, each in a generally rectangular configuration positioned parallel with each other and parallel with the first end portion and second end portion of the peripheral frame. Each plank has a dimension of about 4 inches by 2 inches. Each of the plank members has an upper face 46, a lower face 48 coupled to the top face of the stringers and a pair side faces 50. The side faces have a liner aperture running the distance of thereof adjacent to the lower face. The aperture also has a lip 54 for coupling purposes.

Figure 6:
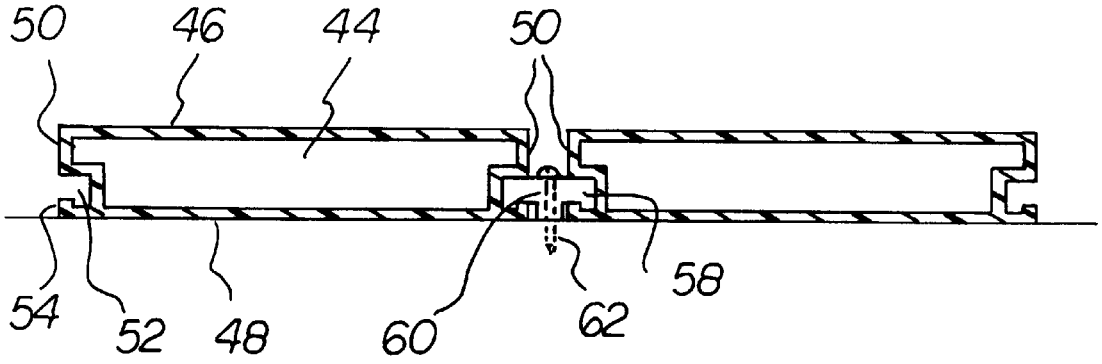
FIG. 6 is a cross-sectional view taken along line 6—6 of FIG. 3.

The plurality of coupling members 58 are next provided. Such coupling members are adapted to slide into the adjacent apertures 52 of adjacent plank members 44. Note FIG. 6. The coupling members to hold the plank member 44 at a uniform distance from each other. Each coupling member also has an aperture 60 adapted to receive a screw 62 which allows the plank members to be rigidly coupled to the stringers.

Lastly provided is a plurality of air filled floating members 66 secured beneath the plank members. These air filled floating members are preferably in a rectilinear configuration. They have apertures 70 allowing them to be coupled by bolts 72 to the side portions of the peripheral frame at equally spaced increments.

In the system as described above, due to its concrete filling in the majority, with lighter weight material in the stringers and planks, undesired movement of the platform is abated due to the peripheral concentration of the weight.

As can be seen in FIGS. 7 and 8, the side portions of the peripheral frame may be of extended lengths. In such embodiment, a short connecting bar 76 is employed for coupling adjacent reinforcement bars. Wire ties 78 couple the ends of the short connecting bar to the reinforcement bars. This allows for floating platforms of extended sizes.

FIGS. 7, 8 and 9 relate to an embodiment with a primary platform and at least one parallel supplemental platform 82. Two such supplemental platforms are shown in FIG. 7. Each such supplemental platform extends laterally from the peripheral frame of the primary platform. The supplemental platform is formed as the primary platform and includes a small peripheral frame of a hollow plastic structure filled with concrete, small stringers of a hollow plastic structure filled with wood and small plank members of a hollow plastic structure. In any of these embodiments there may be further included at least one vertical piling 86. Such piling is preferably of the type disclosed in co-pending application Ser. No. 09/788,794 filed Feb. 20, 2001. The subject matter of such application is included herein by reference.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A peripherally weighted floating platform system for increasing the stability of buoyant structures comprising, in combination:

a rectangular peripheral frame having a first end portion and second end portion with a pair side portions, with the side portion running parallel with each other and intersecting at 90 degree angles with the first end portion and the second end portion, the side portion having a greater length than a length of the end portions, these portions being formed of a hollow plastic structure having a cross section with dimensions of about 6.5 inches by 6.5 inches, these hollow structures having concrete therewithin and a central reinforcement bar running the length of the portions, the end portions being coupled to the side portion with a plurality of male threaded bolts and a plurality of female threaded sleeves in the side portions;

a plurality of hollow plastic stringers filled with wood having about a 4 inch by 4 inch cross section, the stringers positioned parallel with the side portions of the peripheral frame, each stringer having a top face, a bottom face and a pair of side faces, a pair of outer most stringers being coupled to the adjacent side portion of the frame by screws, the top faces having a plurality of apertures along its length;

a plurality of plank members of a generally rectangular configuration lying parallel with each other and the first end portion and second end portion of the peripheral frame, the plank members each having an upper face, a lower face coupled to the top face of the stringers and a pair side faces, the side faces having a liner aperture running the length thereof and adjacent to the lower faces, the aperture further having a lip for coupling purposes;

a plurality of coupling members adapted to slide into apertures of adjacent plank members holding them at a uniform distance from each other, each coupling member further having an aperture and a receiving screw which allows the plank members to be rigidly coupled to the stringers; and a plurality of air filled floating members secured beneath the plank members and having apertures allowing them to be coupled to the side portions of the peripheral frame at equally spaced increments, the majority of the weight of the system being located in the peripheral frame.

2. A peripherally weighted floating platform system comprising:

a peripheral frame with side portions and end portions and formed of a hollow plastic structure with concrete therewithin;

a plurality of stringers parallel with each other and parallel with the side portions of the frame secured to the end portions of the frame; and a plurality of plank members located parallel with each other and parallel with the end portions of the frame secured to the stringers.

3. The system as set forth is claim 2 wherein the majority of the weight of the system is in the peripheral frame.

4. The system as set forth in claim 2 wherein the side portions of the peripheral frame are of extended lengths with reinforcement therewithin and a short connecting bar coupling adjacent reinforcement bars and with wire ties coupling the ends of the short connecting bar to the reinforcement bars.

5. The system as set forth in claim 2 and further including at least one parallel supplemental platform extending laterally from the peripheral frame, the supplemental platform including a small peripheral frame of a hollow plastic structure filled with concrete, small stringers of a hollow plastic structure filled with light weight material and small plank members of a hollow plastic structure.

6. The system as set forth in claim 2 and further including at least one vertical piling.

* * * * *